United States Patent [19]

Murahara

[11] 4,435,099

[45] Mar. 6, 1984

[54] FOUNTAIN PEN WITH MOTOR FEED

[75] Inventor: Koichi Murahara, Isehara, Japan

[73] Assignee: Piolt, Man-Nen-Hitsu Kabushiki Kaisha, Tokyo, Japan

[21] Appl. No.: 128,788

[22] Filed: Mar. 10, 1980

[30] Foreign Application Priority Data

Mar. 13, 1979 [JP] Japan ..... 54-28970

[51] Int. Cl.[3] ..... B43K 5/06; B43K 5/18

[52] U.S. Cl. ..... 401/145; 346/140 A; 401/153; 401/169; 401/179; 401/241

[58] Field of Search ..... 401/2, 145, 153, 169, 401/172, 179, 194, 195, 209, 216, 232, 241; 346/140 R

[56] References Cited

U.S. PATENT DOCUMENTS

| | | | |
|---|---|---|---|
| 1,550,048 | 8/1925 | Ruben | 346/140 R |
| 2,966,844 | 1/1961 | Laupman | 101/123 |
| 3,027,874 | 4/1962 | Bross | 401/153 |
| 3,185,998 | 5/1965 | Bussey | 346/140 R |
| 3,376,551 | 4/1968 | Armbruster | 401/195 |
| 3,779,161 | 12/1973 | Tatube | 101/123 |
| 3,848,529 | 11/1974 | Gegenheimer | 101/363 |
| 3,950,762 | 4/1976 | Anderka | 346/140 R |
| 4,188,634 | 2/1980 | Anderka et al. | 346/140 R |

FOREIGN PATENT DOCUMENTS

| | | | |
|---|---|---|---|
| 187777 | 7/1907 | Fed. Rep. of Germany | 401/153 |
| 1266520 | 4/1968 | Fed. Rep. of Germany | 346/140 R |
| 1032326 | 3/1953 | France | 401/153 |
| 1394248 | 2/1965 | France | 401/195 |
| 683408 | 2/1965 | Italy | 401/195 |
| 236605 | 7/1945 | Switzerland | 401/195 |
| 610253 | 10/1948 | United Kingdom | 401/153 |

*Primary Examiner*—Clyde I. Coughenour

*Attorney, Agent, or Firm*—Sughrue, Mion, Zinn, Macpeak and Seas

[57] ABSTRACT

A fountain pen in which ink is supplied to the tip of the pen under the control of a motor-actuated ink delivery device. An ink holder is formed covering the slit formation region of the pen tip to form an ink pool between the holder and pen tip. A detector is provided in the ink pool for detecting the quantity of ink therein at any time. A pen holder coupled to the pen tip includes an ink storing section opening into the ink pool, an ink delivery device coupled to the ink storing section for delivering ink under pressure, and an electrical power source and a power delivery circuit for controlling the flow of current to an operating motor.

20 Claims, 42 Drawing Figures

FOUNTAIN PEN WITH MOTOR FEED

BACKGROUND OF THE INVENTION

The present invention relates to a fountain pen provided with means for automatically supplying ink to the pen tip in a controlled manner.

A conventional fountain has a pen core for feeding ink from the ink tank to the pen tip. The pen core has an ink groove along which the ink runs and an air groove for introducing air. Unfortunately, if an ink tank having a large capacity is provided in the pen holder, ink may flow over the pen tip resulting in ink dripping because the ink may be supplied to the pen tip at an excessively high rate due to a pressure or temperature change.

As the ink is consumed, the internal pressure of the ink tank initially decreases until air is drawn into the ink tank at which time the internal pressure increases. Thus, during writing with the pen, the internal pressure of the ink tank alternately decreases and increases resulting in a pulsive flow of ink. As a result, the user's handwriting is likely to be irregular in density.

In order to give accent to handwriting, it is necessary to increase the writing pressure. Upon increasing the writing pressure in a conventional fountain pen, the pen tip slit tends to open thereby stopping the flow of ink onto the writing sheet. Furthermore, if a conventional fountain pen is not used for a relatively long time, the ink tends to dry making it difficult to satisfactorily commence writing.

Accordingly, an object of the invention is to provide a fountain pen in which all of the above-described difficulties accompanying a conventional fountain pen have been eliminated.

SUMMARY OF THE INVENTION

The foregoing object and other objects of the invention have been achieved by the provision of fountain pens as hereinafter described.

One of these fountain pens includes a pen tip having a slit, an ink holder covering the slit formation region of the pen in such a manner that an ink pool is formed between the ink holder and the pen with the ink pool communicating with the slit, a detector provided in the ink pool for detecting the quantity of ink held therein, a pen holder coupled to the pen incorporating an ink storing section opening into the ink pool, an ink delivery device coupled to the ink storing section for delivering ink under pressure, an electric source for operating the ink delivery device and a delivery circuit connecting the electric source to the ink delivery device, and a switch circuit connecting the detector to the delivery circuit.

A second fountain pen according to the invention includes a pen tip having a slit, an ink holder covering the slit formation region of the pen in such a manner that an ink pool is formed between the ink holder and the pen with the ink pool communicating with the slit, a writing-pressure-sensitive switch for sensing the contact pressure of the pen tip with a writing sheet, a detector provided in the ink pool for detecting the quantity of the ink held therein, a pen holder coupled to the pen incorporating an ink storing section opening into the ink pool, an ink delivery device coupled to the ink storing section, for delivering ink under pressure, an electric source for operating the ink delivery device and a delivery circuit connecting the electric source to the ink delivery device, and a switch circuit connecting the detector to the delivery circuit with the switch circuit connected in series with the writing-pressure-sensitive switch.

A third fountain pen according to the invention includes a pen tip having a slit, an ink holder covering one surface of the slit formation region of the pen in such a manner that an ink pool is formed between the ink holder and the one surface of the slit formation region of the pen with the ink pool communicating with the slit, a detector provided in the ink pool for detecting the quantity of ink held therein, a pen holder coupled to the pen incorporating an ink storing section opening into the ink pool, an ink delivery device coupled to the ink storing section for delivering ink under pressure, an electric source for operating the ink delivery device and a delivery circuit connecting the electric course to the ink delivery device, a switch circuit connecting the detector to the delivery device, and a cover provided on the other surface of the slit formation region of the pen.

A fountain pen according to the invention is provided with an ink pool. This allows the ink to continuously be transferred onto the sheet even if the slit of the pen is opened and to satisfactorily commence writing even if the pen tip is dry. More specifically, even if the ink has dried in the slit, application of writing pressure will open the slit to break the dried ink so that ink can again pass through the slit to the tip of the pen. In this connection, if the ink pool is provided on the pen tip, the ink can be more quickly supplied than in if the ink pool were to be provided at other positions. It is essential that the ink pool be formed between the pen tip and an ink holder which is positioned to cover the slit formation region of the pen and for the ink pool to be in communication with the slit.

The ink holder may be in the form of a flat plate or a plate member which is curved, in cross section, toward the pen tip. Alternatively, the ink holder may be in the form of a flexible cylinder having a communication hole which communicates with the slit of the pen tip. Furthermore, the ink holder may be formed by a recess which is provided in the surface of the pen core which confronts the slit formation region of the pen tip. Only an ink introducing path which communicates the ink storing section with the ink pool is provided in the pen core. In any case, it is necessary that the ink holder cover the slit formation region of the pen.

The ink pool formed between the ink holder and the pen may be provided on the upper surface or the lower surface of the slit formation region of the pen tip or on both of the upper and lower surfaces. It is essential that the ink pool be in communication with the slit of the pen tip and that the ink pool not be provided at the rear of the pen tip. A capillary material such as sponge may be disposed in the ink pool. However, it is desirable that the ink pool be merely a gap or clearance between the pen and the ink holder because if capillary material holding ink dries, then it becomes rather difficult to retain ink in the ink pool and for the ink to run therefrom.

In the case where the ink pool is formed as a gap, it is preferable that the gap be so designed that capillary action occurs in the gap. With this construction, no ink leakage is possible and ink can be positively delivered to the end of the slit independent of the angle at which the fountain pen is held. It is not always necessary that the capillary gap be provided over the entire length of the ink pool.

In a fountain pen according to the invention, the detector is provided in the ink pool as described above to supply ink under pressure in response to an ink quantity detection instruction outputted by the detector. This overcomes the above-described difficulty that air flows into the ink storing section thus causing the ink to drip and produce a pulsive flow of ink. In order to supply ink under pressure, the ink storing section opening to the ink pool, the ink delivery device coupled to the ink storing section for delivering ink under pressure, the electric source, and the delivery circuit connecting the electric source to the delivery device are built into the pen holder and the detector is coupled through the switch circuit to the delivery circuit.

The detector may be provided as a pair of electrodes or photoelectric elements. The electrode-type detector, if used, is provided in the ink pool. This detector may be formed of one electrode and the pen tip or the ink holder. If an electrode using photoelectric elements is provided, the elements are disposed at measurement positions outside of the ink pool. More specifically, the detector may be formed by a light receiving element only, a combination of a light receiving element and a light emitting element, or a combination of such light receiving and emitting elements and glass fibers confronting these elements in the ink pool. An electrostatic capacity detector may also be employed in which case the entire ink holder, which is electrically insulated, is employed as one of the electrodes.

The ink storing section may be provided in the form of a bellows, a cartridge, or the combination of a piston and a cylinder. In any such ink storing sections, it is essential that the ink storing section open to the ink pool. For improving the ink supplying conditions at least the inside surface of the opening of the ink storing section, which is in the ink pool, should made of a water repellent material such as Teflon TM or polyethylene.

The ink delivery device coupled to the ink storing section can include an electric motor and a pushing member which is attached to the output shaft of the motor to push the ink storing section. In this case, a bellows-type ink storing section or an ink storing section constituted by a piston and cylinder is most suitable. Furthermore, the ink delivery device may be constituted by an electromagnetic valve provided at the opening in the ink pool of the ink storing section and a pressurizing member provided at the rear of the ink storing section. In this case, the pressurizing member is provided as a stretchable or expandable member in which compressed gas or pressurized liquid is stored for pushing out the ink, and the means together with ink is contained in a cartridge. In addition, the ink delivery device may be constructed of an electromagnetic valve provided at the opening of the ink storing section and a pair of repelling magnets provided at the rear of the ink storing section.

The switching circuit employed in the fountain pen of the invention may be constituted by a relay or a semiconductor device or a combination of these elements. The switching circuit operates as follows. Upon receipt of a signal from the detector in the ink pool representative of the fact that the quantity of ink stored has decreased, the switch circuit causes the ink delivery device to supply ink into the ink pool. Upon receipt of a signal representative of the fact that the quantity of ink stored has increased, the switch circuit stops the ink supplying operation of the ink delivery device. For ink delivery device constituted by an electromagnetic valve, the electromagnetic valve is provided with an iron core for opening and closing the opening of the ink storing section and an exciting coil actuating the iron core.

The electric source in the fountain pen of the invention may be an ordinary battery, a rechargeable battery, or a capacitor.

A writing-pressure-sensitive switch for sensing contact of the pen with a writing sheet is provided in a fountain pen of the invention. The reason for this is that the writing-pressure-sensitive switch is activated by the writing motion of the pen during which time the quantity of ink in the ink pool is detected by the detector and, as a result, ink is delivered under pressure into the ink pool. It is essential that the writing-pressure-sensitive switch be connected in series with the switch circuit or the detector so that, when the fountain pen is not in use, the delivery device is electrically disconnected from the electric source so that consumption of electric power is suspended.

The writing-pressure-sensitive switch may be formed by providing an electrode on an end portion of the ink holder and another electrode on a corresponding portion of the pen. Furthermore, the writing-pressure-sensitive switch may be formed by an electrode provided on the end portion of the ink holder or the pen tip itself and another electrode provided above the ink holder. Also, a micro-switch may be employed as the writing-pressure-sensitive switch. Alternatively, the writing-pressure-sensitive switch may be implemented by providing a magnet on the end portion of the ink holder and a reed relay above the magnet in such a manner that the magnet operates the reed relay in response to writing motion of the pen. Moreover, a pressure sensor such as a strain gauge or a piezoelectric element may be fixedly secured to the surface of the pen and thereby used as the writing-pressure-sensitive switch.

In the present invention, the cover is provided on the slit formation region of the pen tip in order to prevent the evaporation of ink from the pen. In this connection, it is necessary that the cover extend over the surface of the slit formation region of the pen tip opposite to the surface on which the ink pool is formed. It is desirable that the cover be made of a soft film so as not lower the flexibility of the pen tip.

Yet further in accordance with the invention there is provided a fountain pen, a pen tip having a slit formed therein, an ink holding plate provided above the pen tip in such a manner that a capillary ink pool is formed between the pen and the ink holding plate with the ink holding plate being made of an electrically non-conductive material, a detector provided in the ink pool for detecting the quantity of ink therein with the detector being formed by the pen tip and an electrode on the surface of the ink holding plate on which the ink pool is formed, a pen holder assembly coupled to the pen wherein the pen holder assembly has an ink storing section which opens into the ink pool, a delivery device having a motor section and a pushing member which is coupled to the output shaft of the motor section so as to depress the ink storing section, a battery connected to the delivery device and the detector, and means for controlling the delivery device in response to an ink quantity detection signal outputted by the detector.

The means for controlling the delivery device according to the ink quantity detection signal from the detectot may be any means which can operate the delivery device so as to supply ink upon receipt of a signal from the detector indicating the fact that the quantity of ink has decreased and to stop the delivery device to suspend the supply of ink upon receipt of a signal from the detector indicating the fact that the quantity of ink has increased. A Schmitt trigger circuit is most suitable, which, forming a hysteresis circuit, does not respond to slight variations of input signals from the detector and can therefore eliminate fluctuations in the output.

DESCRIPTION OF THE PREFERRED EMBODIMENTS

The preferred embodiments of the invention will be described with reference to the accompanying drawings.

Figure 1:
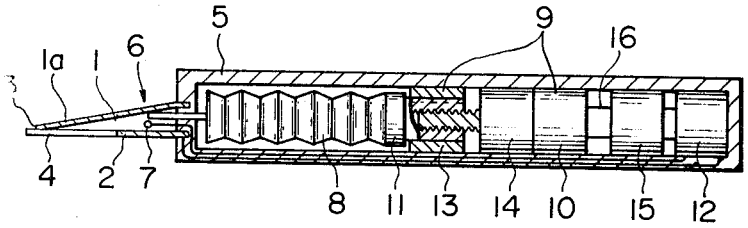
FIG. 1 is a longitudinal sectional view of a first embodiment of a fountain pen according to the invention.

In a first embodiment of a fountain pen according to the invention shown in FIG. 1, an ink pool 1 is formed by an ink holder 1*a* made of a flexible plate material a part or all of which is rectangular, triangular or arcuate. The ink pool 1 is provided in the slit formation region of a pen tip 2 in communication with a slit 4. The tip end 3 of the ink holder is in contact with the slit 4 at a position within about 5 mm from the point of the pen tip 2, preferably within about 3 mm. The opposite end of the ink pool 1 is coupled to the front end portion of a cylindrical pen holder 5.

Figure 1A:
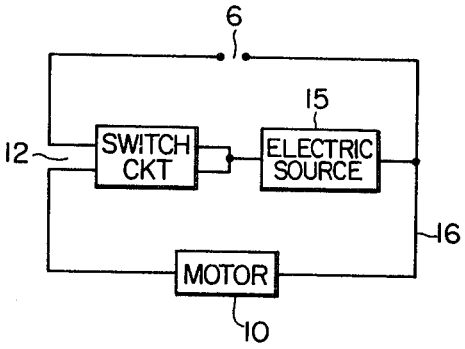
FIG. 1*a* is a circuit diagram showing an electrical circuit employed in the fountain pen in FIG. 1.

The ink pool 1 has a gap in which capillary action occurs with respect to the pen tip. A detector 6 is provided in the ink pool 1. The detector 6 is formed by a platinum contact 7 and the pen tip 2. The contact 7 is disposed close to the pen holder 5. A bellows-type ink storing section 8 opens into the ink pool 1. An ink delivery device 9 is provided for delivering or supplying ink under pressure. The delivery device 9 includes a motor 10 and a pushing member 11 which is coupled to the shaft of the motor 10 so as to push upon the ink storing section 8 in response to activation of the motor 10. In FIG. 1, reference numerals 12 and 15 designate a switch circuit and an electric source, respectively. As shown in FIG. 1*a*, the motor 10 is connected to the detector 6 through the switch circuit 12 which is, for instance, a normally closed relay. More specifically, the detector 6 is connected to an exciting terminal of the relay 12 while the electric source 15 and the motor 10 are connected in series with the contact side of the relay 12. Reference numeral 13 designates a small diameter portion of the pen holder 5 which is adapted to hold the pushing member 11, reference numeral 14 designates a reduction gear forming a part of the shaft of the motor, and reference numeral 16 designates a conductor forming a current delivery circuit.

When no ink is present between the contact 7 and the pen tip 2 in the ink pool, the detector 6 will be open. As a result, the circuit connecting the electric source 15 to the motor 10 is closed by the switch circuit causing the motor 10 to rotate. As a result, the pushing member 11 is moved forward pushing on the ink storing section 8 and causing it to supply ink to the ink pool 1.

When ink is supplied into the ink pool 1 and connection is made to the contact 7 by the pen tip 2 through the ink, the detector 6 is closed and the switch circuit 12 is opened. Therefore, the circuit connecting the electric circuit 15 to the motor 10 is opened thereby stopping the motor 10 as a result of which supply of ink to the ink pool 1 from the ink storing section 8 is suspended. In this fashion, ink is supplied to the ink pool as ink is consumed so that a predetermined quantity of ink is maintained in the ink pool 1 at all times.

Sometimes a fountain pen is used after it has not been used for a relatively long time. In such a case, with the fountain pen described above, the ink can be immediately made to flow by bringing the pen tip 2 into contact with paper because the pen point 3 is positioned close to the end of the slit 4.

Figure 2:
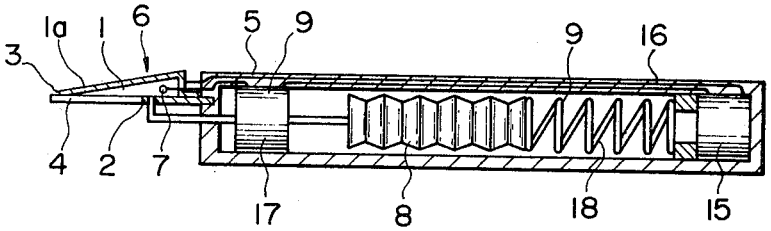
FIGS. 2 and 3 are longitudinal views of second and third embodiments of the fountain pen of the invention, respectively.

Another example of a fountain pen according to the invention is shown in FIG. 2. In this embodiment, an ink holder 1*a* forming an ink pool 1 with a pen tip 2 is coupled to the pen tip 2 and a detector is formed by a contact 7 and the ink holder 1*a*. A delivery device 9 is formed by an electro-magnetic valve 17 provided at the opening of a bellows 8 and a pressurizing member 18 such as a spring which is provided at the rear of the bellows 8. The electromagnetic valve 17 is composed of an iron core and an exciting coil, thus forming a switch circuit.

When ink is emptied from the ink pool 1, a circuit connecting the electric source 15 to the electromagnetic valve 17 is opened as a result of which the electromagnetic valve 17 is not operated and, accordingly, ink is pushed out of the ink storing section 8 into the ink pool 1. When ink is supplied to the ink pool 1, the contact 7 is connected to the ink holder 1*a* through the ink and, accordingly, the electromagnetic valve 17 is excited thereby suspending the supply of ink from the ink storing section 8 to the ink pool 1.

Figure 3:
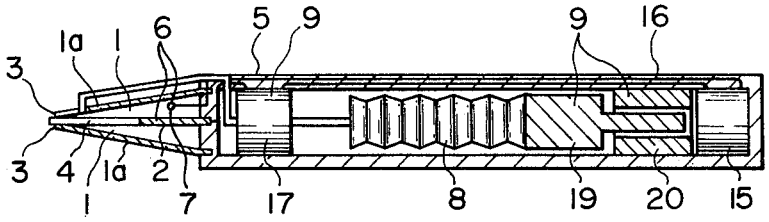

A third example of a fountain pen according to the invention is shown in FIG. 3. Here, instead of the pressurizing member 18 (FIG. 2) a pair of repelling magnets 19 and 20 is provided at the rear of the ink storing section 8 and ink pools 1 are provided on both sides of the slit formation region of the pen 2. This embodiment operates in a similar fashion to those of the above-described first and second examples.

In the above-described examples, the detector is of an electrode type. However, various other detectors may be employed. Examples of such detectors employable in the present invention are shown in FIGS. 4 and 5.

Figure 4:
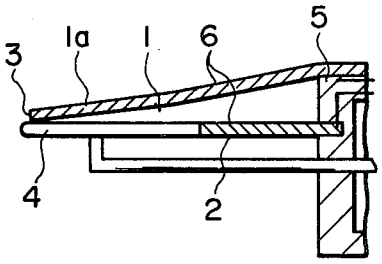
FIG. 4 is an enlarged sectional view showing a part of a fourth embodiment of the fountain pen according to the invention which includes a modification of a detector therein.

Shown in FIG. 4 is an electrostatic capacity detector 6. On electrode of the detector 6 is the pen tip 2 and the other is the ink holder 1*a* which is electrically insulated.

Figure 5:
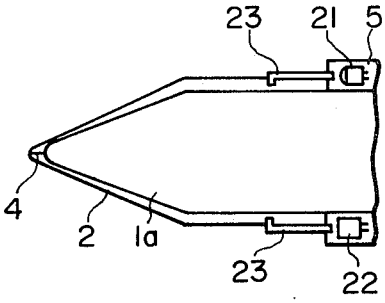
FIG. 5 is an enlarged plan view showing a part of a fifth embodiment of a fountain pen according to the invention which includes another modification of the detector.

The detector shown in FIG. 5 is formed of photoelectric elements. More specifically, the detector is made up of a light emitting element 21, a light receiving element 22 and glass fibers 23 which are provided at measuring positions outside of the ink pool 1.

Figure 6:
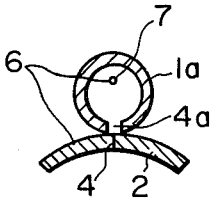
FIG. 6 is an enlarged cross-sectional view showing a sixth embodiment of a fountain pen according to the invention which includes a modification of an ink pool.
Figure 7:
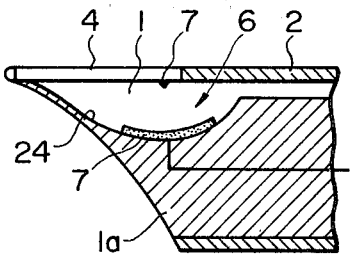
FIG. 7 is an enlarged longitudinal sectional view showing a part of a seventh embodiment of a fountain pen according to the invention which includes another modification of the ink pool.

The ink holder 1*a* may be in the form of a plate, a pen core, or a cylinder as shown in FIGS. 6 and 7. Shown in FIG. 6 is a cylindrical ink holder 1*a* having a communication hole 4*a* which communicates with the slit 4. The ink holder 1*a* is fixedly secured to the pen tip 2. The detector 6 is formed by a contact 7 provided in the cylinder 1*a* and the pen tip 2. Shown in FIG. 7 is an ink holder in the form of a pen core which has a recess 24 confronting the slit formation region of the pen 2. The ink holder 1*a* is coupled to the pen tip which is formed integrally with the front part of the pen holder. The ink pool 1 is provided in the slit formation region of the pen tip 2. The detector is formed by contacts 7 which are fixedly secured to the pen and the recess 24. The recess communicates with the opening of the ink storing section 8.

Figure 8:
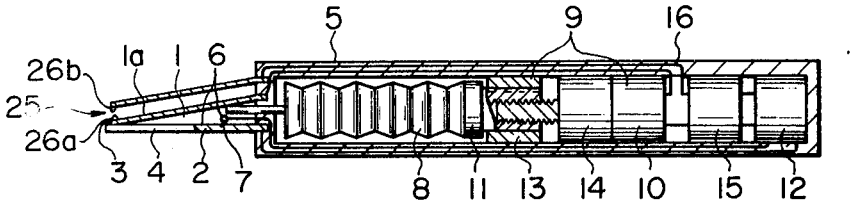
FIG. 8 is a longitudinal sectional view showing an eighth embodiment of a fountain pen according to the invention.
Figure 8A:
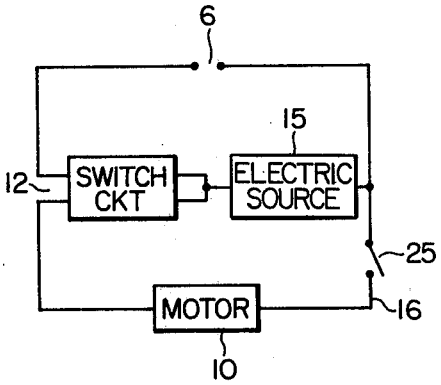
FIG. 8*a* is a circuit diagram showing the electrical circuit of the fountain pen in FIG. 8.

Examples of a fountain pen which are provided with a writing-pressure-sensitive switch according to the invention will be described with reference to FIGS. 8 and 9. In the example shown in FIG. 8, a writing-pressure-sensitive switch 25 is composed of a first electrode 26*a* which is provided at the end portion of an ink holder 1*a* and a second electrode 26*b* provided above the electrode 26*a*. The writing-pressure-sensitive switch 25 is connected in the circuit shown in FIG. 1*a* in series with the switch circuit 12 as shown in FIG. 8*a*.

Figure 9A:
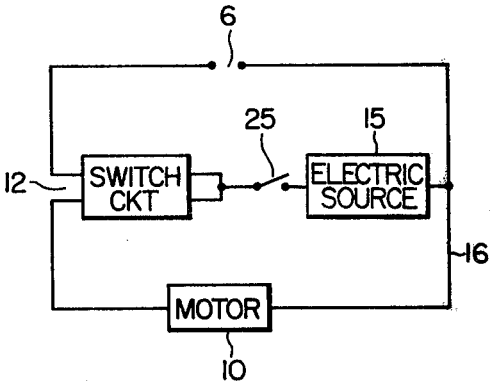
FIG. 9*a* is a circuit diagram showing the electrical circuit of the fountain pen in FIG. 9.
Figure 9:
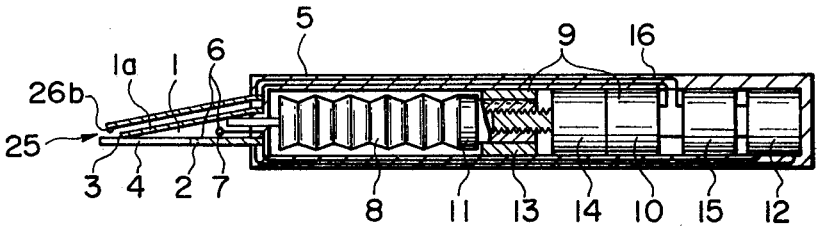
FIG. 9 is a longitudinal sectional view showing a ninth embodiment of a fountain pen of the invention.

In the example shown in FIG. 9, a writing-pressure-sensitive switch 25 is formed by the pen tip 2 and an electrode 26*b* provided above the ink holder 1*a*. The writing-pressure-sensitive switch 25 is connected in the circuit shown in FIG. 1 in series with the switch circuit 12 as shown in FIG. 9*a*.

Figure 10:
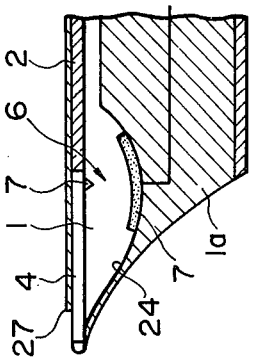
FIG. 10 is an enlarged sectional view showing a part of a tenth embodiment of the fountain pen according to the invention.

In FIG. 10, a cover 27 is provided covering one surface of the slit formation region the opposite surface of which is covered by the ink holder 1*a*.

As is clear from the above description, a fountain pen according to the invention is so constructed that the ink pool is provided in the slit formation region of the pen and ink is delivered under pressure into the ink pool with the aid of the detector provided in the ink pool. It is thus unnecessary to provide an ink introducing path. Thus, the fountain pen according to the invention is meritorious in that a relatively large ink tank can be used, leakage of ink is prevented, the tendency for the user's handwriting to be irregular in density is eliminated, ink is maintained on the pen tip at all times, and writing can be started smoothly and satisfactory.

Figure 11:
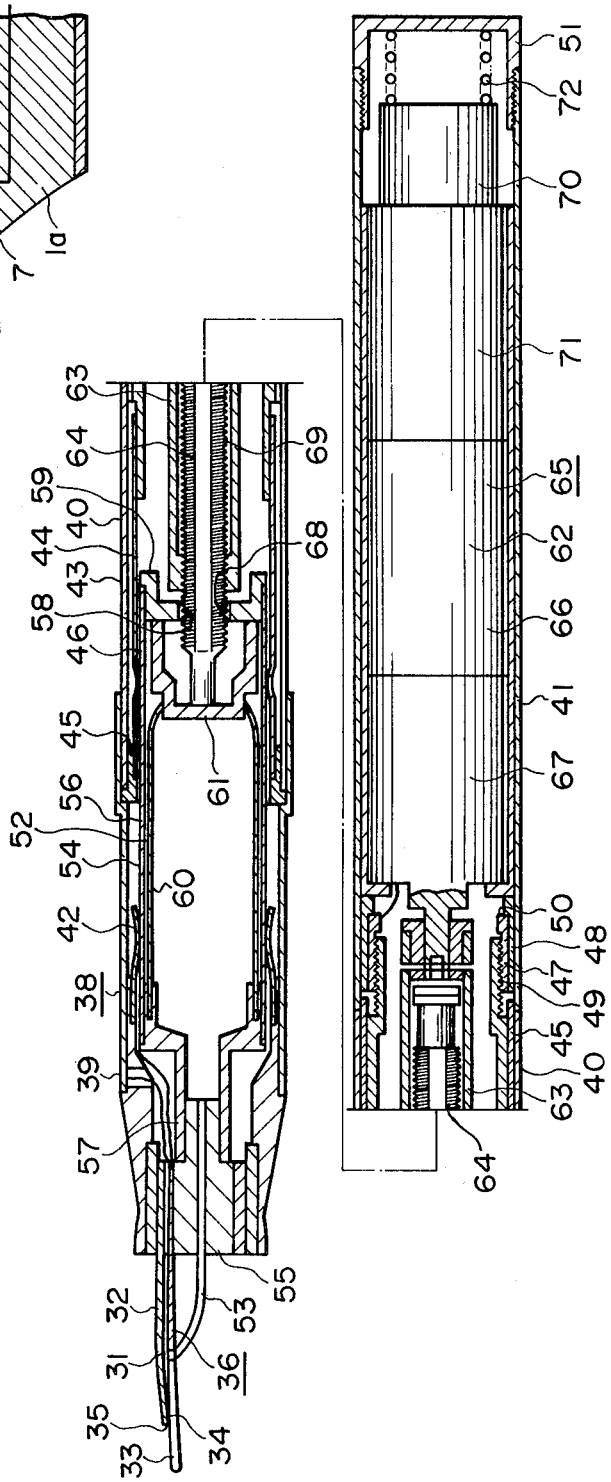
FIG. 11 is a longitudinal sectional view of an eleventh embodiment of a fountain pen according to the invention.

In FIG. 11, reference numeral 31 designates an ink pool. The ink pool 31 is formed by providing an ink holding plate 32 above a pen tip 33 in such a manner that a gap in which capillar action occurs is provided therebetween. The ink holding plate is electrically non-conductive and the ink pool 31 is communication with the slit 34 in the pen tip 33. The end portion 35 of the ink holding plate 32 is in contact with the slit 34 within about 5 mm from the tip end of the pen 33, preferably within about 3 mm.

Figure 12:
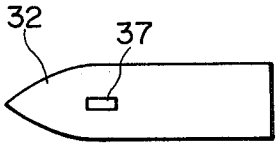
FIG. 12 is a plan view of a surface, on an ink pool side, of an ink holding plate of the fountain pen of FIG. 11 as viewed from above.
Figure 13:
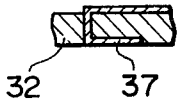
FIG. 13 is an enlarged longitudinal sectional view of the essential parts of the ink holding plate of the fountain pen of FIG. 11.

A detector 36 for detecting the amount of ink present is composed of an electrode 37 and the pen tip 33. The electrode 37 is provided on the surface of the ink holding plate 32 which confronts the pen tip 33 through the ink pool 31 (FIG. 12). The electrode 37 extends through the ink holding plate 32 bending along the ink holding plate and extending rearwardly of the ink holding plate (FIG. 13).

A pen holder assembly 38 includes a neck member 39, an intermediate pen holder 40, and a rear pen holder 41, the neck member 39 being coupled to the pen tip 33 and the ink holding plate 32. The front part of the neck member 39 is made of plastic. A spring contact 42 is provided on the inner surface of the end portion of the front part. The spring contact 42 thus provided is connected through a conductor to the pen tip 33. The rear part of the neck member 39 is made of metal and is connected through a conductor to the electrode 37 on the ink holding plate 32.

The intermediate pen holder 40 coupled detachably to the neck member 39 is formed as a dual cylinder including an outer cylinder 43 and an inner cylinder 44 which are made of metal and are insulated from each other by an insulating material 45 inserted therebetween. The inner wall of the inner cylinder 44 has a protrusion 46 extending inwardly. The rear end portion of the cylinder 44 protrudes outwardly from the outer cylinder 43 and has a threaded portion 47.

The rear pen holder 41 is also made of metal. A metal ring 50 having a threaded portion 49 on its inner wall is provided through an insulator 48 on the intermediate pen holder side of the rear pen holder 41. The threaded portion 39 is engaged with the threaded portion 47 of the intermediate pen holder 40 so that the rear pen holder 41 is coupled to the intermediate pen holder 40. In FIG. 11, reference numeral 51 designates a rear cap.

An ink storing section 52 opening in the ink pool 31 is built into the pen holder assembly 38. The ink storing section 52 includes a pipe 53 and an ink storage body 54 which is detachably connected to the pipe 53. Reference numeral 55 designates a connector which is adapted to connect the pipe 53 to the ink storage body 54 and to fixedly secure the pipe 53 to the neck member 39. The ink storage body 54 is composed of a metal cylinder 56 and an insertion mouth 57 extending from the metal cylinder body with the insertion mouth 54 being coupled to the connector 55. Fitted into the other end of the cylinder 56 is a rear plug 59 having therein a hole 58. A flexible ink storing pouch 60 coupled to the insertion mouth 57 is positioned within the cylinder 56. A follower 61 is fixedly secured to the end of the ink storing pouch 60.

One side of an electrical circuit is formed by connecting the spring contact 42 of the neck member 39 and the protrusion 46 of the intermediate pen holder 40 to the cylinder 56 of the ink storing section 52 in the pen holder assembly 38 as is apparent from the above description.

A delivery device 65 including an electric motor section 62 and a pushing member 64 coupled to the shaft 63 of the motor section for pushing on the ink storing section 52 is included in the pen holder assembly 38. The motor section 62 is composed of an electric motor 66 and a reduction gear 67. The shaft 63 of the motor extends from the reduction gear 67 and a threaded portion 68 is provided on the end of the shaft 63. The pushing member 64 has a threaded portion which is engaged with the aforementioned threaded portion 69 on the outer surface. The pushing member 64 is positioned inside the shaft 63 of the motor in such a manner that the end of the pushing member extends through the hole 58 in the ink storing section 52 and abuts against the follower 61.

A battery 70 is provided in the pen holder assembly 38 and is connected to the delivery device 65 and the detector 36. Furthermore, the delivery device 65 and the detector 36 are coupled through a control device 71 which operates the delivery device 65 in response to an ink quantity detection signal outputted by the detector 36. The motor 66 is connected through conductors to the metal ring 50 of the rear pen holder 41. In FIG. 11, reference numeral 72 designates a coil spring.

Figure 14:
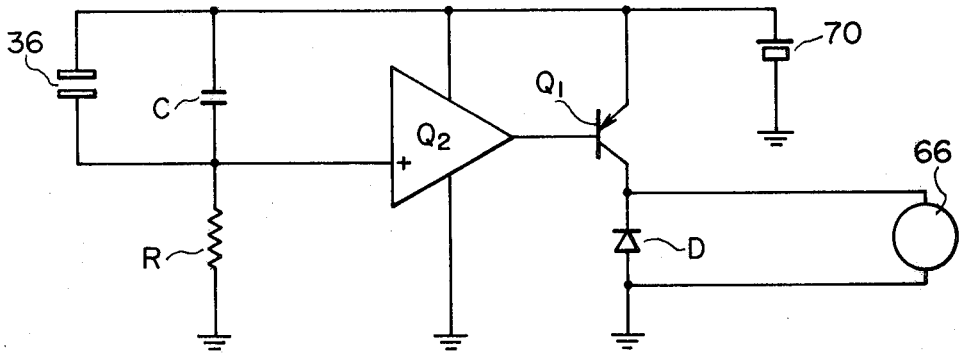
FIG. 14 is a circuit diagram showing an electrical circuit employed in the fountain pen of FIG. 11.

A specific example of the control device is the electrical circuit shown in FIG. 14. This circuit includes a capacitor C, a resistor R, a voltage comparator $Q_2$, a PNP type transistor $Q_1$, and a protective diode D. The thus constructed circuit forms a Schmitt trigger circuit.

With the fountain pen according to the invention constructed as described above, when there is no ink between the electrode 37 in the ink pool 31 and the pen tip 33, the detector 36 is in the open state. As a result, the input voltage to the voltage comparator $Q_2$ decreases and, correspondingly, the output thereof decreases. Therefore, the transistor $Q_1$ is rendered conductive thereby applying current to the motor 66 causing it to rotate. As the shaft 63 of the motor rotates, the pushing member 64 is moved forwardly deforming the ink storing pouch 60. The ink storing pouch 60 is inflated outwardly upon being depressed by the pushing member 64.. However, as the inflation of the pouch is limited by the cylinder 56, the ink storing pouch is successively deformed from the end toward the insertion mouth 57 without being twisted so as to supply ink into the ink pool 31 at a suitable flow rate.

When the electrode 37 is connected to the pen tip 33 through the ink supplied to the ink pool 31, the detector 36 is closed. As a result, the input voltage to the voltage comparator $Q_2$ increases and the output thereof also increases. Therefore, the transistor $Q_1$ is rendered nonconductive, the supply of current of the motor 66 is suspended, the motor 66 stops and the supply of ink to the ink pool 1 from the ink storing section is suspended. As the ink in the ink pool 1 is consumed, the pen tip 33 is disconnected from the electrode 37 and the detector 36 is opened again thus again supplying ink to the ink pool 1.

Figure 15:
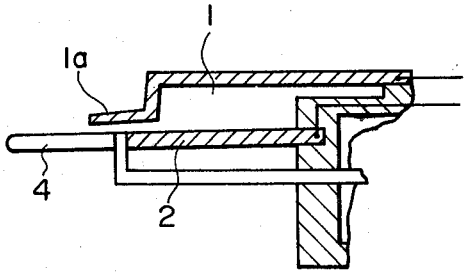
FIG. 15 is a longitudinal view of a twelfth embodiment of the fountain pen according to the invention.

A number of further modifications of the above described embodiments. In FIG. 15 the ink pool 1 is formed between the pen tip 2 and a flange portion of the ink holder **1*a* which is positioned to cover the slit formation region of the pen. The ink pool 1 in this embodiment is in communication with the slit 4**. With this construction, with an ink pool having a capillary gap is formed between the pen tip and the ink holder, the same meritorious effects as described above are obtained.

Figure 16:
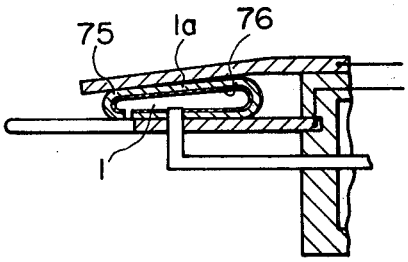
FIG. 16 is a longitudinal sectional view of a thirteenth embodiment of a fountain pen according to the invention.

In FIG. 16, the ink holder **1*a* is provided in the shape of a pouch and forming the ink pool 1 is disposed on the upper surface of the slit formation region of the pen tip. Also, the outer surface of the ink holder is constructed of electrically conductive flexible material 75 while the inner surface thereof is constructed of electrically nonconductive flexible material 76**. When no ink is present in the ink pool, the pouch-shaped ink holder shrinks thereby disconnecting the electrode from the pen tip. As a result, ink is supplied into the ink pool. When ink is supplied into the ink pool, the pouch-shaped ink holder expands thereby connecting the electrode to the pen. As a result, the supply of ink into the ink pool is suspended. Further, since the inner surface of the pouch-shaped ink holder is made of a conductive material, the ink is electrically isolated from the electric source and therefore polarization of the ink will not be occurred.

Figure 17:
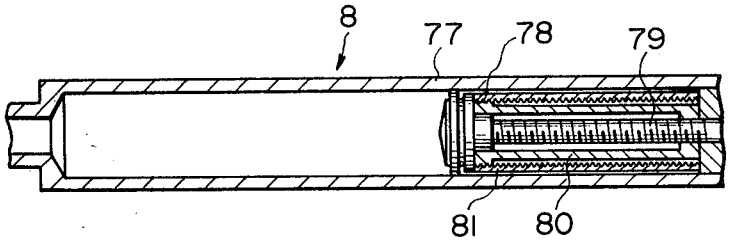
FIGS. 17–19 are longitudinal sectional views of a fourteenth embodiment of a fountain pen according to the invention.
Figure 18:
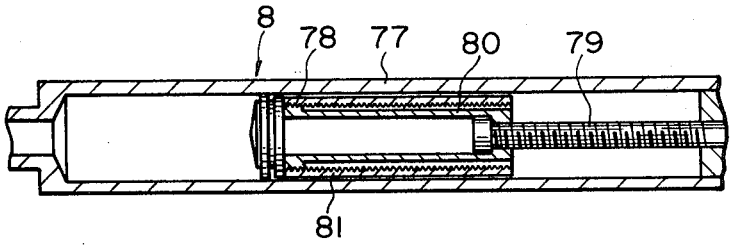
Figure 19:
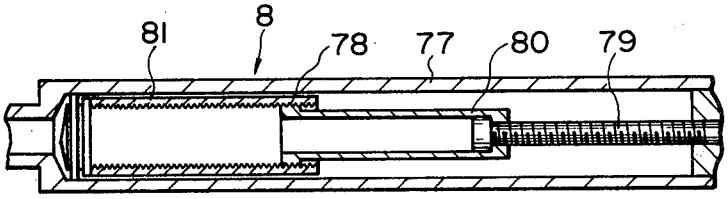

In the modification of FIGS. 17-19, the ink storing section 8 is composed of a cylinder 77 and a multi-stepped piston 78. Specifically, the piston 78 includes a screw rod 79 connected to the motor, an intermediate cylinder 80 of which the inner end is in threaded engagement with the screw rod 79 and an outer cylinder 81 of which the inner periphery is in threaded engagement with the intermediate cylinder 80 and of which the outer end is fitted to the cylindrical pen holder. When the motor rotates the screw rod 79, the intermediate cylinder 80 moves forwardly because the outer cylinder 81 threadedly engaged with the intermediate cylinder 80 fittingly engages the cylindrical pen holder. When the forward movement of the intermediate cylinder is terminated, the outer cylinder 81 threadedly engaged with the intermediate cylinder 80 moves forwardly. In this regard, it is also possible to use a second stepped piston in which the screw rod fittingly engages the outer cylinder. The use of such a multi-stepped piston results in a shortening of the overall length of the fountain pen.

Figure 20:
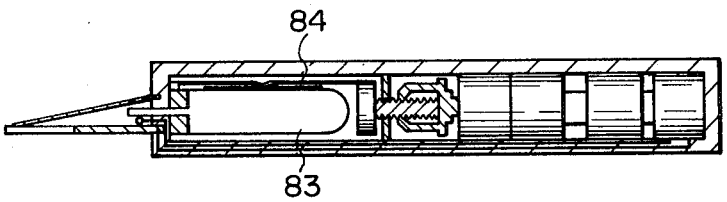
FIG. 20 is a longitudinal sectional view of a fifteenth embodiment of a fountain pen according to the invention.
Figure 21:
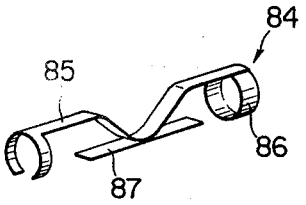
FIG. 21 is a perspective view showing a spring member used in the embodiment shown in FIG. 20.
Figure 22:
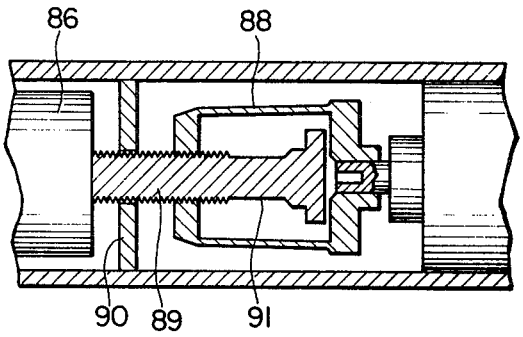
FIG. 22 is a longitudinal sectional view showing essential parts of the collet and pressurizing member of the embodiment of FIG. 20.

As illustrated in FIGS. 20-22, the ink storing section 8 includes an elastic tube 83 and a spring device 84 having a spring plate 85, a short tube 86 attached to the free end of the spring plate 85, and a pushing member attached to the base of the spring plate 87 which is disposed to push upon the side portion of the elastic tube 83. The delivery device includes a collet 88 connected to the drive shaft of the motor and a pressurizing member 89 having a portion thereof threadedly engaged with the collet. When the motor rotates the collet, the pressurizing member is advanced by a guide 90. According to the advancement of the pressurizing member 89, the short tube 86 is pressed upon thereby bending the spring plate 85 as a result of which pressure is exerted on the elastic tube 83. Thus, ink is delivered or supplied under pressure due to deformation of the elastic tube 83. After the advancement of the pressurizing member is terminated, the collet 88 is returned to the position of the small diameter portion as a result of which the collet is raced. As stated above, since the ink storing section is constructed with the described elastic tube and spring device, the elastic tube can be sufficiently pressurized with only a slight movement of the pressurizing member resulting in a shortening of the overall length of the fountain pen. Also, since the rotation of the collet is not transmitted to the pressurizing member after the advancement of the pressurizing member is terminated due to the presence of a small diameter portion 91, damage to the motor and the pressurizing member is prevented.

Figure 23:
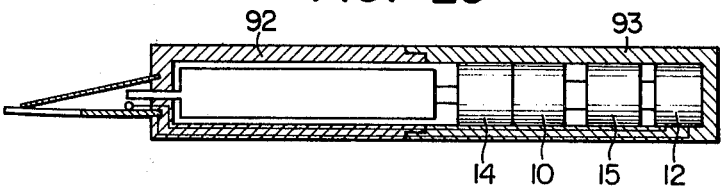
FIG. 23 is a longitudinal sectional view of a sixteenth embodiment of a fountain pen according to the invention.
Figure 24:
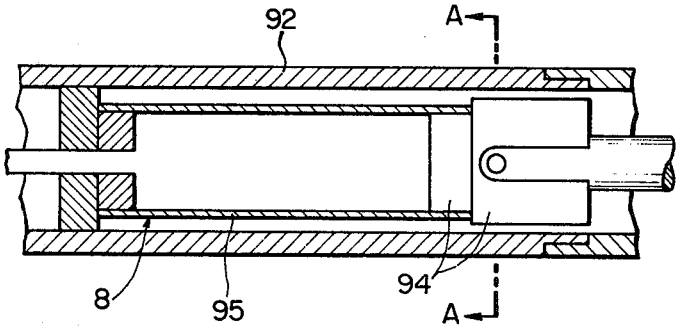
FIG. 24 is a longitudinal sectional view showing essential parts of the ink pool of the embodiment of FIG. 23.
Figure 25:
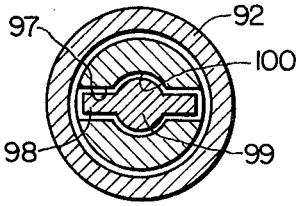
FIG. 25 is a transverse sectional view taken through FIG. 24.

In the embodiment of FIGS. 23-25, the delivery device is formed by a pressurizing member 94 which pushes upon the ink storing section which is here provided in a front cylindrical pen holder 92. The pressurizing member is connected to the output shaft of the motor 10 provided in a rear cylindrical pen holder. The front and rear cylindrical pen holders are connected together. The pressurizing member 94 is provided with a key groove 97 and an insertion hole 100 through which passes the motor shaft 99 and is connected at one and to an elastic tube 95. Also, a key 98 engaged with the key groove 97 is provided on the motor shaft 99 within the insertion hole. When the motor rotates, the pressurizing member 94 also rotates because of the engagement of the key 98 with the key groove 97. Upon rotation of the pressurizing member 94, the elastic tube 95 is twisted thereby delivering ink under pressure. After the ink is depleted, the rear cylindrical pen holder 93 is moved to the right of the position shown in FIG. 24. Then, in accordance with this movement, the motor shaft 99 disengages from the pressurizing member 94, as a result of which the twisted elastic tube is returned to its original state. At this time, the pen tip may be dipped into an inkpot and ink sucked into the elastic tube 95. The rear cylindrical pen holder 93 is then moved to the left and the key 98 on the motor shaft 99 is inserted into the key groove 97 on the pressurizing member 94 and the elastic tube is again pressurized. Thus, since ink is delivered under pressure by the twisting of the elastic tube 95, no advancement of the motor shaft is needed resulting in a shortening of the overall length of the fountain pen. Furthermore, since the pressurizing member and the motor axle are provided in the front and rear cylindrical pen holders, respectively and they are also detachably engaged with each other, supply and repeated pressurization of the ink can be made by moving only the rear cylindrical pen holder.

Figure 26:
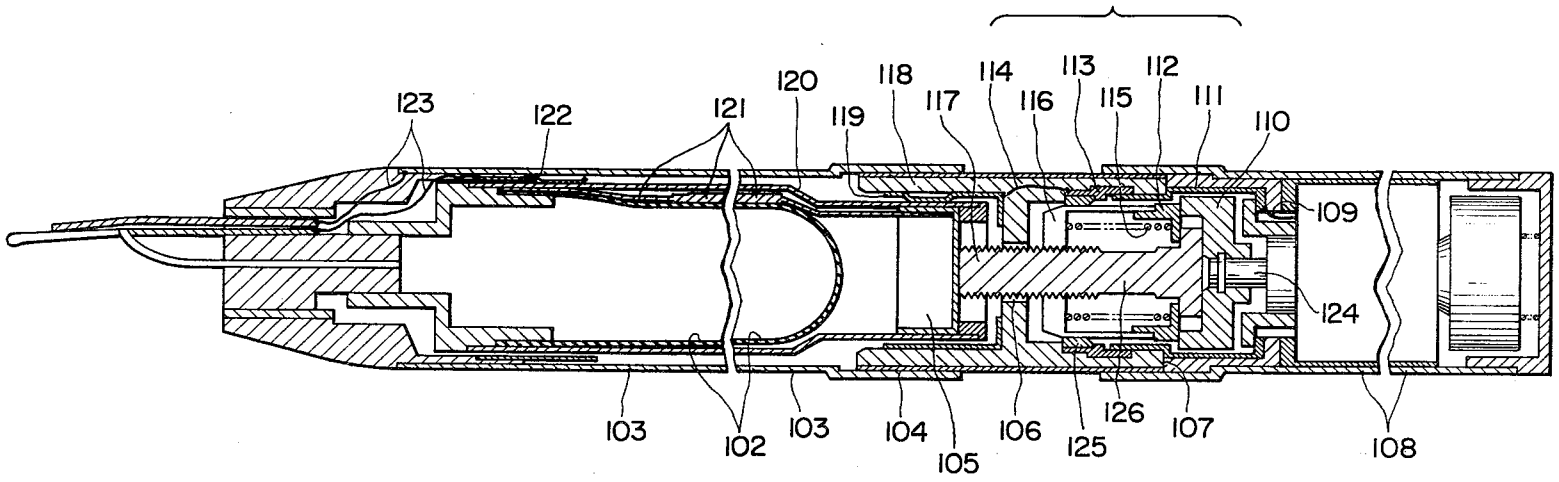
FIG. 26 is a longitudinal sectional view of a seventeenth embodiment of a fountain pen according to the invention.
Figure 28:
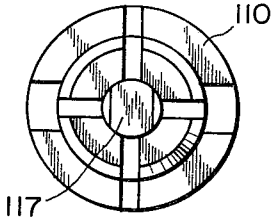
FIG. 28 is a transverse sectional view taken through FIG. 26.
Figure 27:
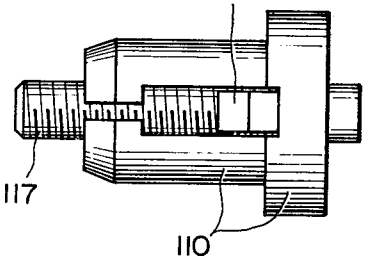
FIG. 27 is a side view of a collet and screw rod used with the embodiment of FIG. 26.

Referring next to FIGS. 26–28, the ink storing section 8 includes an elastic tube 102 and a spring 121 provided in a front cylindrical pen holder 103. The pressurizing member includes a screw rod 117, a collet 110 which is connected to the motor shaft 124 and is threadably engaged with the screw rod 117, a coil spring 115 and spring receiving member 112 provided in a rear cylindrical pen holder 108. A connecting cylinder 118 is provided for connecting the front cylindrical holder 103 to the rear cylindrical pen holder 108. Also, the connecting cylinder 118 is provided with a pushing ring 125 which engages the guide of the screw rod 117 and the outer periphery of a collet 116. The outside of the connecting cylinder 118 is formed as a conductor and the inside thereof as a insulator. When the motor rotates, the collet 110 connected to the motor shaft 124 also rotates thereby advancing the screw rod 117 guided by the connecting cylinder. During such times, the spring receiving member 112 depresses the coil spring 115 and moves in the same direction as the screw rod 117. As a result, the screw rod pushes on the short tube 105 of the ink storing section to thereby deliver ink in the elastic tube under pressure. Further, as the screw rod 117 advances, the collet 116 arrives at the small diameter portion 126 of the screw rod 117 as a result of which the collet is raced. After the ink is dissipated, the connecting cylinder is moved to the right of the position shown in FIG. 26. In accordance with this movement, the screw rod 117 disengages from the ink storing section, as a result of which the deformed elastic tube and spring are returned to their original states. At this time, the pen tip may be dipped in an inkpot and ink can be sucked into the elastic tube 102. The rear cylindrical pen holder 108 is then moved to the left with respect to the connecting cylinder and engagement between the collet 116 and the pushing ring 125 is released thereby expanding the collet 116. As a result, the screw rod 117 is drawn into the collet 116 by the elastic force of the spring 115. Thereafter, the rear cylinder pen holder 108 is moved to the left and the collet 116 moves inside the pushing ring 125 and the collet 116 comes into engagement with the screw rod 117. Further, in this condition, if the connecting cylinder 118 is moved to the left so that the screw rod 117 comes into contact with the short tube 105 of the ink storing section, the elastic tube 102 can be pressurized again. Thus, by the use of the spring 121, the overall length of the fountain pen can be shortened. Further, by moving the connecting cylinder 118 and the rear cylindrical pen holder 108, supply and repeat pressurization of ink can be made.

Figure 29:
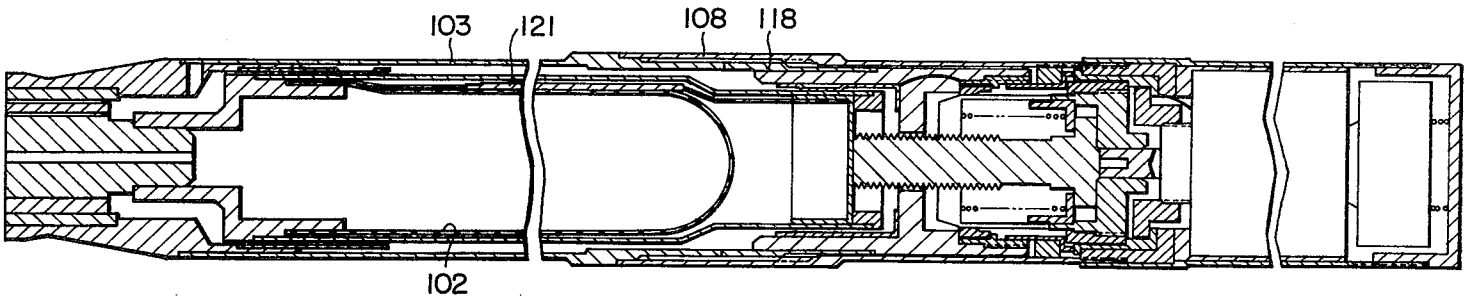
FIG. 29 is a longitudinal sectional view of an eighteenth embodiment of a fountain pen according to the invention.
Figure 30:
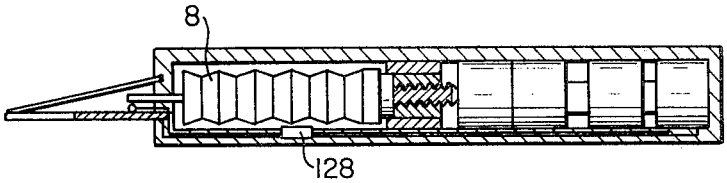
FIGS. 30–32 are longitudinal sectional views of nineteenth embodiment of a fountain pen according to the invention.
Figure 31:
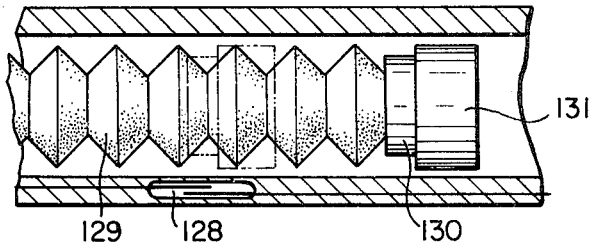

A modification of the embodiments of FIGS. 26–28 is shown in FIG. 29. This embodiment differs from that of FIGS. 26–28 in that the connecting cylinder is secured to the front cylindrical pen holder and the rear cylindrical pen holder has a tip end opening in threaded engagement with the outer periphery of the connecting cylinder. When the rear cylindrical pen holder 108 is rotated, it moves to the right from the position shown in FIG. 29. In accordance with this movement, the collet 110 provided in the rear cylindrical pen holder and the motor also move to the right as a result of which the collet 116 expands, the screw rod 117 is drawn into the collet 116, and the supply of ink is supplemented the same as in the embodiment of FIGS. 26–28. Also, if the rear cylindrical pen holder 108 is rotated in the other direction, the collet 116 advances and comes into engagement with the pushing rod while the screw rod 117 further comes into contact with the short tube 105 of the ink storing section as a result of which the elastic tube is again pressurized.

Figure 32:
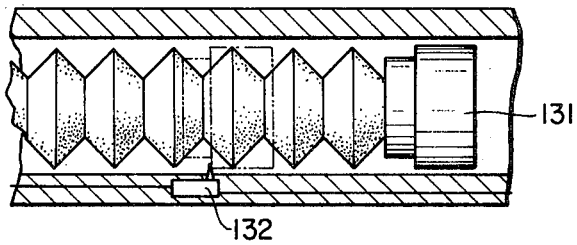
Figure 33:
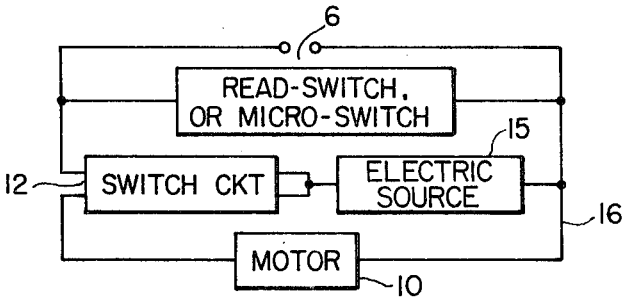
FIG. 33 is a diagram of a circuit used with the embodiment of FIGS. 30–32.

FIGS. 30–33 show an embodiment of the invention in which the detector which detects the displacement of an ink pressurizing device 131 or the ink storing section 8 and in which the motor is stopped in response to a displacement detection signal produced by the detector. In FIGS. 30–33, the end portion of the pressurizing device 131 which pushes upon the bellows of the ink storing section is formed by a magnet 130. A reed switch 128 is disposed alongside the path of the magnet. In this case, a cylinder and the elastic tube may of course be used rather than the bellows for the ink storing section. Also, a micro-switch 132 may be used instead of the reed switch as shown in FIG. 32. When the pressurizing device advances upon rotation of the motor and the magnet 130 attached to the pressurizing device passes the reed switch 128 provided in the pen holder, the reed switch 128 is operated thereby stopping the current drive to the motor. Thus, as the ink in the ink storing section is consumed, the motor is stopped thereby preventing the consumption of the electric power.

Figure 34:
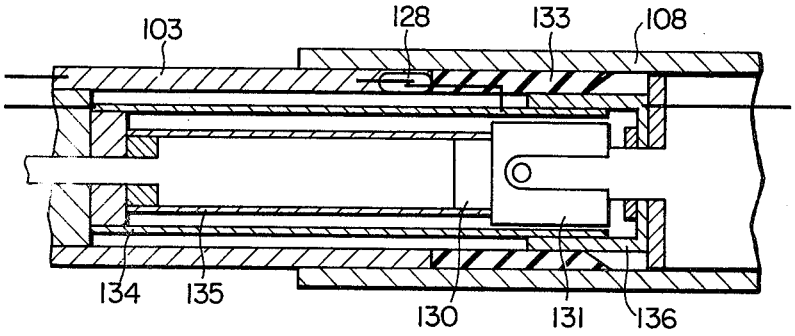
FIGS. 34 and 35 are longitudinal sectional views of a twentieth embodiment of a fountain pen according to the invention.
Figure 35:
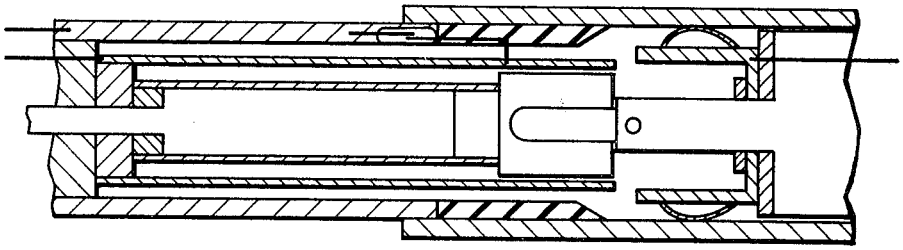
Figure 36:
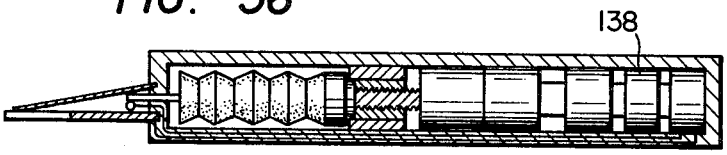
FIG. 36 is a longitudinal sectional view of a twenty-first embodiment of a fountain pen according to the invention.
Figure 37:
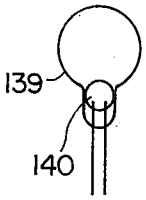
FIGS. 37 and 38 are diagrams of a position-sensitive switch used with the embodiment of FIG. 36.
Figure 38:
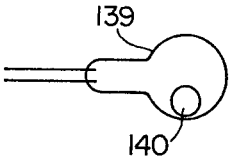
Figure 39:
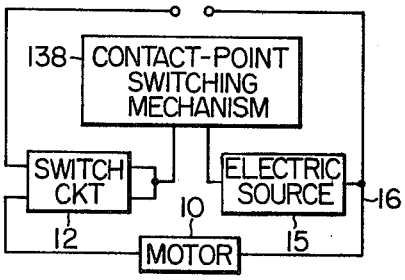
FIG. 39 is a circuit diagram of a circuit used with the embodiment of FIG. 36.

The embodiment of FIGS. 30–33 may be modified as follows. As shown in FIG. 34, the front cylindrical pen holder 103 through which the motor operating current passes, namely a conductive tube 134, is electrically conductive and the portion of the front cylindrical pen holder which fits into the rear cylindrical pen holder is insulated. When the motor rotates, the pressurizing device also rotates because of the engagement of the key with the key groove (see FIG. 25). By rotation of the pressurizing device, the elastic tube 135 is twisted to thereby deliver ink under pressure. Also, by twisting of the elastic tube 135, the pressurizing device is moved to the left fron its position as shown in FIG. 34 and when the magnet 130 of the pressurizing device passes through the reed switch 128 provided in the front cylindrical pen holder 103, the reed switch 128 is operated thereby stopping the drive of the motor. After the ink is consumed, if the rear cylindrical pen holder 108 is moved to the right, the motor shaft then follows in accordance with the movement of the rear cylindrical pen holder 108 to thereby disengage the pressurizing device as a result of which the twisted elastic tube 135 is returned to its original state. Simultaneously, a cylindrical contact 136 which had been in contact with the insulated portion of the front cylindrical pen holder 103 moves in accordance with the movement of the rear cylindrical pen holder 108 disengaging from the insulated portion and then coming into contact with the rear cylindrical pen holder 108 by means of the spring force of the cylindrical contact which is electrically conductive. As a result, the cylindrical contact 136 and the rear cylindrical pen holder 108 are short-circuited and the motor is stopped. At this time, if the pen tip is dipped in an inkpot, ink can be sucked into the elastic tube 135. Furthermore, if the rear cylindrical pen holder 108 is moved so that the key of the motor shaft is disposed in the key groove of the pressurizing device, the elastic tube may be pressurized again. Thus, since the fitting portion of the front cylindrical pen holder 103 which fits into the rear cylindrical pen holder 108 is insulated and as the motor has been stopped, re-engagement of the motor shaft and pressurizing device can be easily achieved.

FIGS. 36–39 show an embodiment having a contact-point switching mechanism 138 of the type in which engagement or disengagement thereof is made in accordance with the angle of inclination of the fountain pen. As illustrated in FIGS. 36–39, the contact-point switching mechanism 138 includes an insulated capsule 139, two leads and a body of electrically conductive material 140. Mercury or a metal ball can be used for the body of electrically conductive material. With this construction, electric power can be supplied only in a writing position thereby preventing unneeded consumption of the electric power.

What is claimed is:

1. A hand-held fountain pen comprising:

a pen tip having a slit formation region and a slit formed therein;

an ink holder covering said slit formation region in said pen tip and shaped so as to form a discrete ink pool formed by capillary action and/or surface tension between said ink holder and said pen tip and said ink pool held in place in any functional position of said pen, said ink pool communicating with said slit;

a detector provided in said ink pool for detecting the quantity of ink therein;

a pen holder coupled to said pen tip, said pen holder having an ink storing section with conduit means opening into said ink pool, an ink delivery device coupled to said ink storing section for delivering ink under pressure, an electric power source for operating said ink delivery device, and a power delivery circuit connecting said electric source to said ink delivery device; and a switch circuit connecting said detector to said power delivery circuit whereby in response to a detection of the absence of ink, said power delivery circuit operates said ink delivery device to supply ink to said ink holder from said ink storing section.

2. The fountain pen as claimed in claim 1 in which said ink holder is in the form of a plate.

3. The fountain pen as claimed in claim 1 in which said ink holder is in the form of a cylinder having a communication hole which communicating with said slit in said pen tip.

4. The fountain pen as claimed in claim 1 further comprising a pen core and in which said ink holder is formed as a recess in a surface of said core which confronts said slit formation region of said pen tip.

5. The fountain pen as claimed in claim 1 in which said ink pool is provided on the upper surface of said slit formation region of said pen tip.

6. The fountain pen as claimed in claim 1 in which said ink pool is provided on the lower surface of said slit formation region of said pen tip.

7. The fountain pen as claimed in claim 1 in which ink pools are provided on both upper and lower surfaces of said slit formation region of said pen tip, respectively.

8. The fountain pen as claimed in claim 1 in which said detector comprises a pair of electrodes provided in said ink pool.

9. The fountain pen as claimed in claim 1 in which said detector comprises a single electrode provided in said ink pool.

10. The fountain pen as claimed in claim 1 in which said detector comprises photoelectric elements provided at measurement positions outside of said ink pool.

11. The fountain pen as claimed in claim 1 in which said detector comprises an electrostatic capacity detector.

12. The fountain pen as claimed in claim 1 in which said ink storing section comprises a bellows-shaped member.

13. The fountain pen as claimed in claim 1 in which said ink storing section comprises a piston and a cylinder.

14. The fountain pen as claimed in claim 1 in which said ink delivery device comprises an electric motor and a pushing member coupled to said shaft of said electric motor for depressing said ink storing section.

15. The fountain pen as claimed in claim 1 in which said ink delivery device comprises an electromagnetic valve provided at the ink pool opening of said ink storing section and a pressurizing member provided at the rear of said ink storing section.

16. The fountain pen as claimed in claim 1 in which said ink delivery device comprises an electromagnetic valve provided at the ink pool opening of said ink storing section and a pair of repelling magnets provided at the rear of said ink storing section.

17. A hand-held fountain pen comprising:

a pen tip having a slit formation region and a slit formed therein;

an ink holder covering said slit formation region in said pen tip and shaped so as to form a discrete ink pool formed by capillary action and/or surface tension between said ink holder and said pen tip and said ink pool held in place in any functional position of said pen, said ink pool communicating with said slit;

a writing-pressure-sensitive switch for sensing contact of said pen tip with a writing surface;

a detector provided in said ink pool for detecting the quantity of ink therein;

a pen holder coupled to said pen tip, said pen holder having an ink storing section with conduit means opening into said ink pool, an ink delivery device coupled to said ink storing section for delivering ink under pressure, an electric power source for operating said ink delivery device, and a power delivery circuit connecting said electric source to said ink delivery device; and a switch circuit connecting said detector to said power delivery circuit, said switch circuit being connected in series with said writing-pressure-sensitive switch, whereby in response to a detection of the absence of ink said power delivery circuit operates said ink delivery device to supply ink to said ink holder from said ink storing section.

18. A hand-held fountain pen comprising:

a pen tip having a slit formation region and a slit formed therein;

an ink holder covering a first surface of said slit formation region in said pen tip and shaped so as to form a discrete ink pool formed by capillary action and/or surface tension between said ink holder and said first surface of said slit formation region of said pen tip, said ink pool held in place in any functional position of said pen, said ink pool communicating with said slit;

a detector provided in said ink pool for detecting the quantity of ink therein;

a pen holder coupled to said pen, said pen holder having an ink storing section with conduit means opening into said ink pool, an ink delivery device coupled to said ink storing section for delivering ink under pressure, an electric power source for operating said ink delivery device, and a power delivery circuit connecting said electric source to said ink delivery device;

a switch circuit connecting said detector to said power delivery circuit; and a cover provided on the surface of said slit formation region of said pen opposite said first surface whereby in response to a detection of the absence of ink said power delivery circuit operates said ink delivery device to supply ink to said ink holder from said ink storing section.

19. A hand-held fountain pen comprising a nib pen tip, an ink supply, a source of electrical power, detector means operating in response to the quantity of ink in a discrete ink pool formed by capillary action and/or surface tension adjacent said nib pen tip and held in place in any functional position of said pen and, means for transferring ink from said ink supply to said pen tip in response to electrical power from said electrical power source actuated by said detector means whereby in response to a detection of the absence of ink by said means for transferring ink is operable to provide ink to said nib tip.

20. The fountain pen as claimed in claim 19 wherein said transferring means comprises motor means.

* * * * *